US011819858B2

(12) United States Patent
Singhal et al.

(10) Patent No.: US 11,819,858 B2
(45) Date of Patent: Nov. 21, 2023

(54) REFINER PLATE SEGMENTS HAVING FEEDING GROOVES

(71) Applicant: Andritz Inc., Alpharetta, GA (US)

(72) Inventors: Arvind M. Singhal, Muncy, PA (US); Long Nguyen, Muncy, PA (US)

(73) Assignee: ANDRITZ INC., Alpharetta, GA (US)

( * ) Notice: Subject to any disclaimer, the term of this patent is extended or adjusted under 35 U.S.C. 154(b) by 403 days.

(21) Appl. No.: 16/782,519

(22) Filed: Feb. 5, 2020

(65) Prior Publication Data

US 2020/0246801 A1 Aug. 6, 2020

Related U.S. Application Data

(60) Provisional application No. 62/802,117, filed on Feb. 6, 2019.

(51) Int. Cl.

| | |
|---|---|
| ***B02C 7/12*** | (2006.01) |
| ***D21D 1/30*** | (2006.01) |
| ***D21D 1/00*** | (2006.01) |

(52) U.S. Cl.

CPC ..... *B02C 7/12* (2013.01); *D21D 1/008* (2013.01); *D21D 1/30* (2013.01)

(58) Field of Classification Search

CPC .... B02C 7/02; B02C 7/06; B02C 7/10; B02C 7/12; B02C 7/182; D21D 1/30; D21D 1/008

(Continued)

(56) References Cited

U.S. PATENT DOCUMENTS 3,910,511 A 10/1975 Leider et al.
5,425,508 A * 6/1995 Chaney ..... D21D 1/306 241/296

(Continued)

FOREIGN PATENT DOCUMENTS

CN 1651646 8/2005
CN 103374849 10/2013

(Continued)

OTHER PUBLICATIONS

Copenheaver, Blaine R., International Search Report, Written Opinion, and Search History, dated Apr. 7, 2020, pp. 1-13, ISA/USA, Alexandria, Virginia, USA.

(Continued)

*Primary Examiner* — Katrina M Stransky
*Assistant Examiner* — Smith Oberto Bapthelus
(74) *Attorney, Agent, or Firm* — Kilpatrick Townsend & Stockton LLP

(57) ABSTRACT

This disclosure relates to refiner plate segments having feeding grooves having a first width at a first end of the feeding groove, wherein the first end of the feeding groove is disposed closer to an inner diameter of the refiner plate segment, and a second end of the feeding groove having a second width, wherein the second end of the feeding groove is disposed closer to the outer diameter than the first end and wherein the second width is less than the first width. It is believed that the increased width of the feeding groove at the inner diameter, coupled with the change in angle or curve of the feed groove from a feeding angle to a holding angle such that the centrifugal force applied to the lignocellulosic material surpasses the plugging force, allows for improved hydraulic capacity over the refiner plate segment without reducing refining efficiency.

17 Claims, 4 Drawing Sheets

(58) Field of Classification Search
USPC ..... 241/261.3
See application file for complete search history.

(56) References Cited

U.S. PATENT DOCUMENTS

| | | | | |
|---|---|---|---|---|
| 6,032,888 | A | 3/2000 | Deuchars | |
| 6,325,308 | B1 | 12/2001 | Lofgren et al. | |
| 6,607,153 | B1 | 8/2003 | Gingras | |
| 2005/0161542 | A1 | 7/2005 | Theut | |
| 2006/0113415 | A1 | 6/2006 | Antensteiner | |
| 2008/0191078 | A1 | 8/2008 | Gingras | |
| 2008/0296419 | A1* | 12/2008 | Gingras | D21D 1/306 241/261.3 |
| 2013/0015281 | A1 | 1/2013 | Gingras | |
| 2013/0320119 | A1 | 12/2013 | Gingras | |
| 2014/0077016 | A1 | 3/2014 | Gingras | |
| 2016/0145798 | A1* | 5/2016 | Sjöström | D21D 1/306 241/298 |
| 2018/0327970 | A1* | 11/2018 | Sjöström | D21D 1/24 |
| 2020/0246801 | A1 | 8/2020 | Singhal et al. | |

FOREIGN PATENT DOCUMENTS

| | | | |
|---|---|---|---|
| CN | 108729289 | | 11/2018 |
| CO | 92288276 | | 6/1988 |
| GB | 1355971 | A | 6/1974 |
| JP | 2009024317 | | 2/2009 |
| JP | 2009221648 | | 10/2009 |
| JP | 2017532464 | A | 11/2017 |
| RU | 2636165 | | 11/2017 |
| WO | 0010710 | A1 | 3/2000 |

OTHER PUBLICATIONS

Indian Application No. 202147039775, First Examination Report dated Mar. 8, 2022, 6 pages.
International Application No. PCT/US2020/016766, International Preliminary Report on Patentability dated Aug. 19, 2021, 8 pages.
Russian Application No. 2021122398, Office Action dated Dec. 29, 2021, 15 pages (8 pages of Original Document and 7 pages of English Translation).
Chinese Application No. 202080012773.5, Office Action dated May 26, 2022, 17 pages (9 pages of Original Document and 8 pages of English Translation).
Russian Application No. 2021122398, Notice of Decision to Grant dated May 25, 2022, 19 pages (10 pages of Original Document and 8 pages of English Translation).
Australian Application No. 2020219780, First Examination Report dated Apr. 28, 2022, 3 pages.
European Application No. 20752954.6, Extended European Search Report dated Oct. 7, 2022, 8 pages.
Japanese Application No. 2021-545792, Office Action dated Jul. 22, 2022, 7 pages (4 pages of English translation and 3 pages of original document).
Chilean Application No. 202101964, Office Action dated Aug. 19, 2022, 22 pages (3 pages of English summary and 19 pages of original document).
Australian Application No. 2020219780, Subsequent Examination Report dated Sep. 21, 2022, 4 pages.
Chinese Application No. 202080012773.5, Office Action dated Dec. 6, 2022, 14 pages (7 pages of Original Document and 7 pages of English Translation).
Japanese Application No. 2021-545792, Office Action dated Jan. 23, 2023, 4 pages.
Chilean Patent Application No. 202101964, Office Action, dated Feb. 20, 2023, 24 pages (21 pages original document, 3 pages English summary).
Australian Application No. 2020219780, Notice of Acceptance dated Mar. 30, 2023, 3 pages.
Chinese Application No. 202080012773.5, Office Action dated Mar. 1, 2023, 19 pages (11 pages of English Translation and 8 pages of Original Document).
Chinese Application No. 202080012773.5, Office Action dated May 22, 2023, 16 pages. (9 pages of English Translation and 7 pages of Original Document).
Colombian Application No. 2021/0009580, Office Action dated Apr. 27, 2023, 15 pages (7 pages of English Summary and 8 pages of Original Document).
Canadian Application No. 3127383, Office Action dated Oct. 31, 2022, 8 pages.
Indonesian Application No. P00202105932, Office Action dated Nov. 14, 2022, 4 pages (2 pages of Original Document and 2 pages of English Translation).
Chile Application No. CL202101964, Notice of Allowance dated Jun. 30, 2023, 3 pages (2 pages original document, 1 page English summary).
Canadian Application No. CA3, 127,383, Office Action dated Jul. 24, 2023, 6 pages.
Japanese Application No. JP2021-545792, Notice of Allowance dated Jul. 21, 2023, 6 pages (3 pages of original document, 3 pages English summary).
Chinese Application No. 202080012773.5, Notice of Decision to Grant datedn Aug. 21, 2023, 6 pages (2 pages of English Translation and 4 pages of original document).

* cited by examiner

REFINER PLATE SEGMENTS HAVING FEEDING GROOVES

CROSS-RELATED APPLICATION

This application claims the benefit under 35 U.S.C. § 119(e) of the earlier filing date of U.S. Provisional Patent Application No. 62/802,117 filed on Feb. 6, 2019, the entire contents of which is incorporated herein by reference.

BACKGROUND OF THE INVENTION

Technical Field

The present disclosure relates generally low consistency refining and more particularly to refiner plate segments for low-consistency refiners configured to separate, develop, and cut lignocellulosic material.

Related Art

Refiners typically separate, develop, and cut lignocellulosic material into fibers to endow the fibers with certain mechanical and physical properties suitable for use in pulp, paper, boards, building materials, packing materials, liquid-absorbent filler materials, and other products.

A refiner typically comprises two or more opposing refiner assemblies. Each assembly has a pattern of raised refining bars on a refining side. Grooves separate adjacent refining bars. Typically, these refining assemblies are either circular discs, annular discs, or nested conical frustums configured to rotate around a common axis. Each refiner assembly may comprise several annular sector-shaped segments bolted to a backing structure to form the refiner circular disc, refiner annular disc, or refiner conical frustum. The refining sides of the opposing refining assemblies face each other to define a narrow refining gap separating the opposing refiner assemblies. At least one of the refining assemblies is a rotor configured to rotate around the axis.

In general, refiners can be characterized as either a high-consistency refiner ("HCR") or a low-consistency refiner ("LCR"). LCRs are generally used to refine pulp. Pulp is a mixture of the fibers (wood or non wood) in water and this is usually at a consistency of 1.5% to 8%. The pulp may contain other additives. Mill operators typically use low-consistency refining to mechanically fibrillate and cut the pulp fibers to desired quality. The refined material is generally then converted into different types of papers, and/or additives.

As the rotor refining assembly spins, operators pump cellulosic fibers or other feed material into the refiner and through the refining gap. The cellulosic fibers are generally tube-like structures comprising a number of concentric layers called "lamellae" or "fiber walls." Each lamella comprises finer structural components called "fibrils" that are bound to one another to form the lamella. The refining bars and grooves on opposing refiner assemblies successively overlap as the rotor spins. A typical low-consistency rotor refiner assembly spins in a range of about 325 rotations per minute ("rpm") 1,000 rpm. Pulp consistency may be at about 1.5% (i.e. the pulp and other solids concentration is about 1.5 units per every hundred units of water) to about 8%.

Successively overlapping opposing bars and grooves alternatively compress and permit expansion of pulp in the refining gap. This rapid alternating compression and expansion creates a fiber pad. Refining primarily occurs in the fiber pad. The friction delaminates the fibers and frays the fibrils that comprise the lamellae, thereby increasing the surface area of the fibers greatly. This in turn contributes to the strength of papers or other products manufactured from the fibrous pulp. In other words, forceful movement of feed material against adjacent feed material in the fiber pad contributes significantly to the fibers' development, separation, and cutting. This is known as "primary refining."

Pulp mills faced with increased production demands often have limited resources to invest in further equipment. This motivates many pulp mill operators to run refiners above the refiners' production capacity limits. For refiners, this is a function of the pulp consistency and the lignocellulosic material's flow rate through the refiners. Because consistency of the pulp is generally restricted by the system, a desire to increase production capacity typically results in operators increasing the lignocellulosic material's flow rate through the refiner beyond the refiner's designed capacity.

In the past, steps to improve the lignocellulosic flow rate by increasing the hydraulic capacity of the refiner plate system came at the expense of refining efficiency. Traditionally, designers have sought to improve hydraulic capacity by using two, separate types of feeding grooves. The first type of feeding groove were radially outward feeding grooves. The second type of feeding grooves were feeding grooves disposed at an angle. Whereas a majority of feeding grooves have a constant width throughout the plate surface, some refiner plate segments had feeding grooves that narrowed towards the outer diameter at a constant rate.

SUMMARY OF THE INVENTION

The problem of reduced refining efficiency in the face of marginally improved hydraulic capacity is solved by using a refiner having a refiner plate segment comprising a feeding groove having a first width at the inner diameter ("ID") that is larger than a second width of the feeding groove nearer to the outer diameter ("OD") than the first width. Furthermore, the feeding groove has an angle, whereby the angle is a "feeding" or "pumping" angle at the inner diameter, and a "holding" or "holdback" angle near the outer diameter, while transforming through the radial section between the inner diameter and the outer diameter. In this manner, it is contemplated that refiner plate segments in accordance with the exemplary embodiments described herein can improve the hydraulic capacity between the opposing refiner plate assemblies while further improving refining efficiency.

In an exemplary embodiment, the angle changes multiple times from the inner diameter to the outer diameter. In other exemplary embodiments, the feeding groove is curved, such that the angle changes constantly along the radius of the refiner plate segment. The curvature or other change in angle can be directed where there is enough centrifugal force achieved for a given diameter of the plates that is beyond the normal pulp plugging point.

Without being bounded by theory, Applicant has discovered that the area of the refiner plate segment toward the inner diameter is significantly lower than the area of the refiner plate segment toward the outer diameter. The area is a function of the radius of the refiner plate segment squared. Because the inner diameter is the most constrictive part, Applicant has determined that this is where plugging is most likely to occur, thus contributing to low hydraulic capacity.

In certain exemplary embodiments, the feeding groove may extend to the outer diameter. Such embodiments may improve hydraulic capacity but reduce refining efficiency. In other exemplary embodiments, the feeding groove may terminate before reaching the outer diameter such that refining bars cross over the end of the feeding groove, thereby placing a physical stop of the lignocellulosic material passing through the feeding groove. This allows more refining bars to be placed where the refining bars have the highest peripheral velocity, and therefore, the highest refining efficiency.

Without being bound by theory, it is believed that the increased width of the feeding groove at the inner diameter, coupled with the change in angle or curve of the feed groove from a feeding angle to a holdback angle such that the centrifugal force applied to the lignocellulosic material surpasses the plugging force, while mounted on a refiner allows for improved hydraulic capacity over the refiner plate segment without reducing refining efficiency. The centrifugal force may ensure that the pulp fed through the feeding angle of feeding groove is evenly fed into and distributed smoothly over the refining surface of the refining plate. The holdback angled feeding groove near the outer diameter retains the lignocellulosic material in the outer refining section longer, thereby ensuring that the lignocellulosic material does not pass though the refining section unrefined (and thereby maintains refining efficiency).

BRIEF DESCRIPTION OF THE DRAWINGS

The foregoing will be apparent from the following more particular description of exemplary embodiments of the disclosure, as illustrated in the accompanying drawings. The drawings are not necessarily to scale, with emphasis instead being placed upon illustrating the disclosed embodiments.

DETAILED DESCRIPTION OF THE INVENTION

Figure 1A:
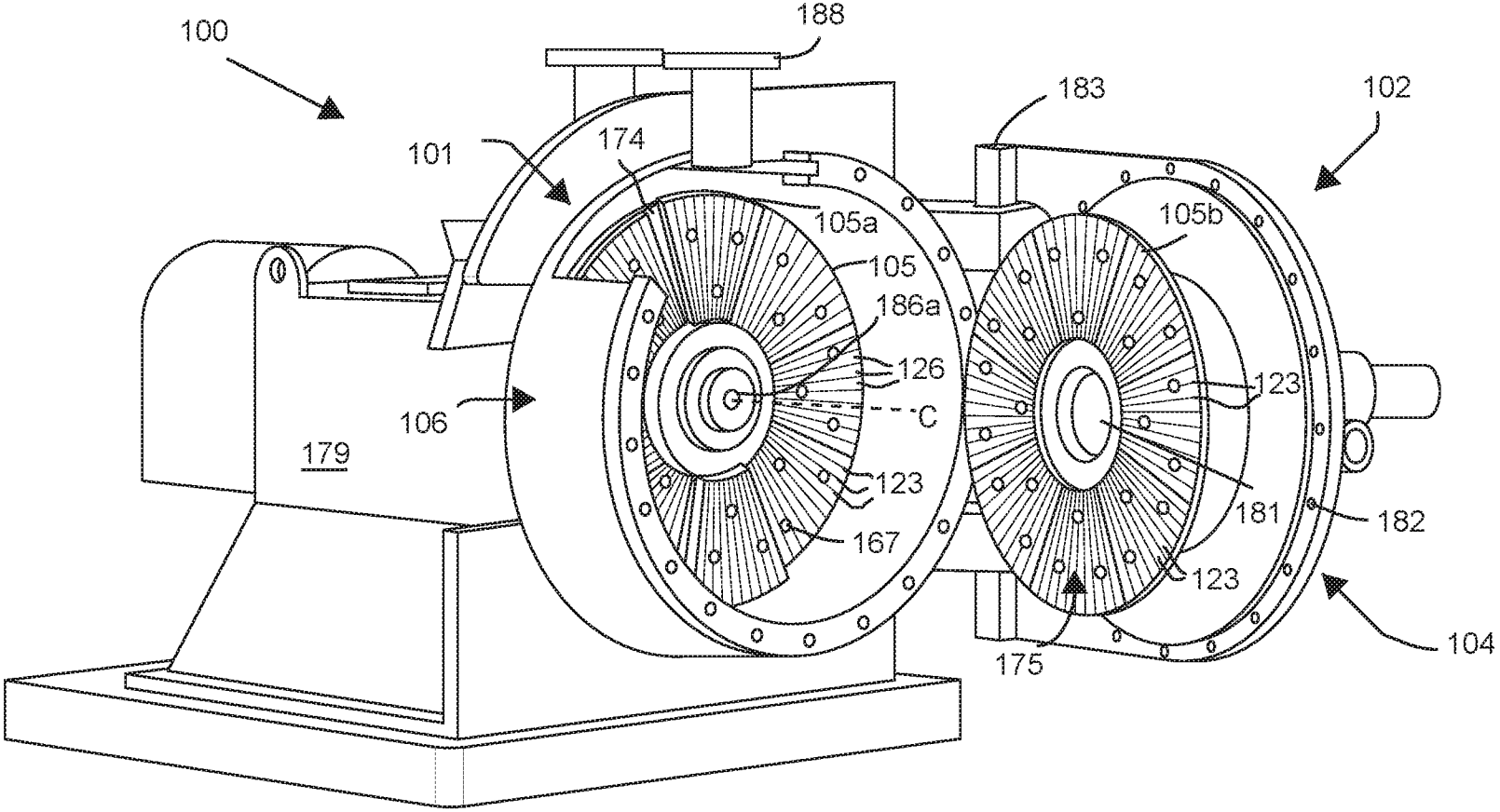
FIG. 1A is a perspective view of a low consistency refiner capable of using exemplary refiner plate segments as more fully defined herein.

The following detailed description of the preferred embodiments is presented only for illustrative and descriptive purposes and is not intended to be exhaustive or to limit the scope and spirit of the invention. The embodiments were selected and described to best explain the principles of the invention and its practical application. One of ordinary skill in the art will recognize that many variations can be made to the invention disclosed in this specification without departing from the scope and spirit of the invention.

Similar reference characters indicate corresponding parts throughout the several views unless otherwise stated. Although the drawings represent embodiments of various features and components according to the present disclosure, the drawings are not necessarily to scale and certain features may be exaggerated in order to better illustrate embodiments of the present disclosure, and such exemplifications are not to be construed as limiting the scope of the present disclosure.

Except as otherwise expressly stated herein, the following rules of interpretation apply to this specification: (a) all words used herein shall be construed to be of such gender or number (singular or plural) as to circumstances require; (b) the singular terms "a," "an," and "the," as used in the specification and the appended claims include plural references unless the context clearly dictates otherwise; (c) the antecedent term "about" applied to a recited range or value denotes an approximation within the deviation in the range or values known or expected in the art from the measurements; (d) the words "herein," "hereby," "hereto," "hereinbefore," and "hereinafter," and words of similar import, refer to this specification in its entirety and not to any particular paragraph, claim, or other subdivision, unless otherwise specified; (e) descriptive headings are for convenience only and shall not control or affect the meaning or construction of any part of the specification; and (f) "or" and "any" are not exclusive and "include" and "including" are not limiting. Further, the terms, "comprising," "having," "including," and "containing" are to be construed as open-ended terms (i.e., meaning "including but not limited to").

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

To the extent necessary to provide descriptive support, the subject matter and/or text of the appended claims is incorporated herein by reference in their entirety.

Recitation of ranges of values herein are merely intended to serve as a shorthand method of referring individually to each separate value falling within the range of within any sub ranges there between, unless otherwise clearly indicated herein. Each separate value within a recited range is incorporated into the specification or claims as if each separate value were individually recited herein. Where a specific range of values is provided, it is understood that each intervening value, to the tenth or less of the unit of the lower limit between the upper and lower limit of that range and any other stated or intervening value in that stated range or sub range hereof, is included herein unless the context clearly dictates otherwise. All subranges are also included. The upper and lower limits of these smaller ranges are also included therein, subject to any specifically and expressly excluded limit in the stated range.

It should be noted that some of the terms used herein are relative terms. For example, the terms "upper" and "lower" are relative to each other in location, i.e. an upper component is located at a higher elevation than a lower component in a given orientation, but these terms can change if the device is flipped. The terms "inlet' and "outlet" are relative to a fluid flowing through them with respect to a given structure, e.g. a fluid flows through the inlet into the structure and flows through the outlet out of the structure. The terms "upstream" and "downstream" are relative to the direction in which a fluid flows through various components, i.e. the flow of fluids through an upstream component prior to flowing through the downstream component.

The terms "horizontal" and "vertical" are used to indicate direction relative to an absolute reference, i.e. ground level. However, these terms should not be construed to require structure to be absolutely parallel or absolutely perpendicular to each other. For example, a first vertical structure and a second vertical structure are not necessarily parallel to each other. The terms "top" and "bottom" or "base" are used to refer to locations/surfaces where the top is always higher than the bottom/base relative to an absolute reference, i.e. the surface of the Earth. The terms "upwards" and "downwards" are also relative to an absolute reference; an upwards flow is always against the gravity of the Earth.

FIG. 1A depicts a disc refiner 100 having a first refining assembly 101 oppositely disposed from a second refining assembly 102. The first refining assembly 101 is a rotor refining assembly configured to spin around an axis of rotation C. The second refining assembly 102 is a stator refining assembly. The first and second refining assemblies 101, 102 sit within a housing 179. Each refining assembly 101, 102 comprises a plurality of refiner plate segments (shown as 105*a* on the first refining assembly 101 and 105*b* on the second refining assembly 102) annularly arrayed to form a ring mounted on the backing structure 174. FIG. 1A shows the housing's stator side 104 open around hinges 183 to better depict the respective refining assemblies 101, 102. However, for operation, the stator side 104 closes around the hinge 183 and fasteners (not depicted) extend through the respective fastener holes 182 to fixedly engage the housing's stator side 104 to the rotor side 106. When the second refining assembly 102 and first refining assembly 101 face each other, the second refining assembly 102 and the first refining assembly 101 define a gap between the refining sections 175 of the facing refiner plate segments 105*a*, 105*b*. Where useful to improve precision when discussing features on the first refining assembly in relation to facing features on the second refining assembly, Applicant will use and "a" to refer to particular features on the first refining assembly 101 and "b" to refer to particular features on the second refining assembly 102.

Bolts or other fasteners (not depicted) may extend through fastener holes 167 to engage the refiner plate segments 105 to the backing structure 174 and thereby fixedly engage the annular sector-shaped refiner plate segments 105 to the backing structure 174.

Figure 1B:
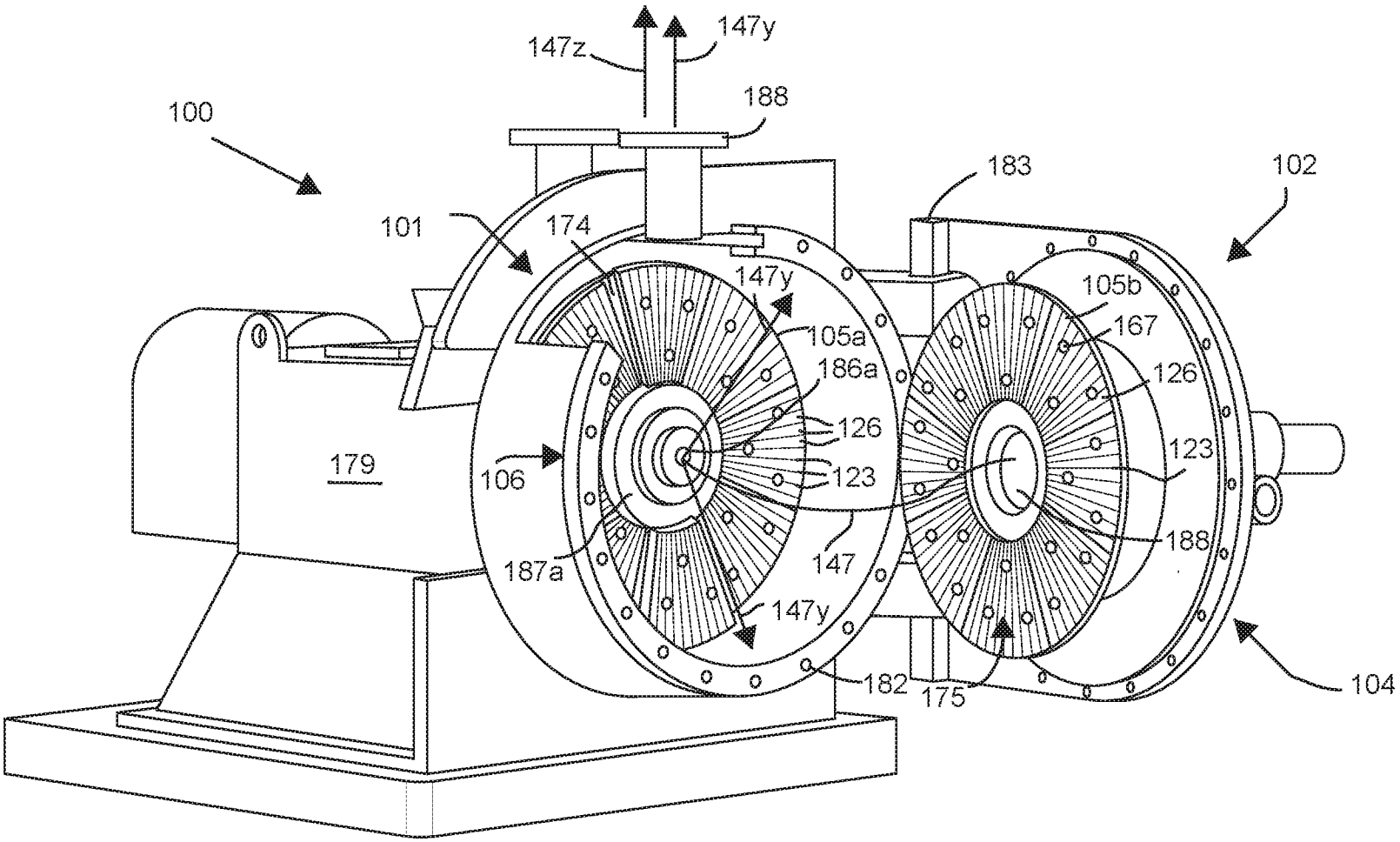
FIG. 1B is a perspective view of a low consistency refiner capable of using exemplary refiner plate segments as more fully defined herein.

In an active refiner 100, feed material 147 (FIG. 1B), which may be lignocellulosic feed material (commonly in the form of pulp or wood chips), flows through an opening 181 in the center of the stator refining assembly 102 before encountering the rotor hub 186*a* or rotor flinger 187*a* (FIG. 1B). The rotor refining assembly 101 typically spins around the axis of rotation C in a range of 325 to 1,000 rpm, and thereby flings the feed material 147 radially outwardly and into the refining gap. Breaker bars (225, FIG. 2) may break down the feed material 147 before the feed material 147 flows still further through the refining gap and traverses a refining section 175 defined by fields of alternating refining bars 123 and refining grooves 126 on opposing refiner plate segments 105*a* and 105*b*. The refined material 147*z* (FIG. 1B) and partially ground material 147*y* (FIG. 1B) exits the refiner 100 through an outlet 188. Operators may then screen the desirably refined material 147*z* from the partially ground material 147*y* and transfer the partially ground material 147*y* to a second stage refiner (see 100). Operators may chemically treat the partially ground material 147*y* in lieu of or in addition to subjecting the partially ground material 147*y* to further refining.

Figure 2:
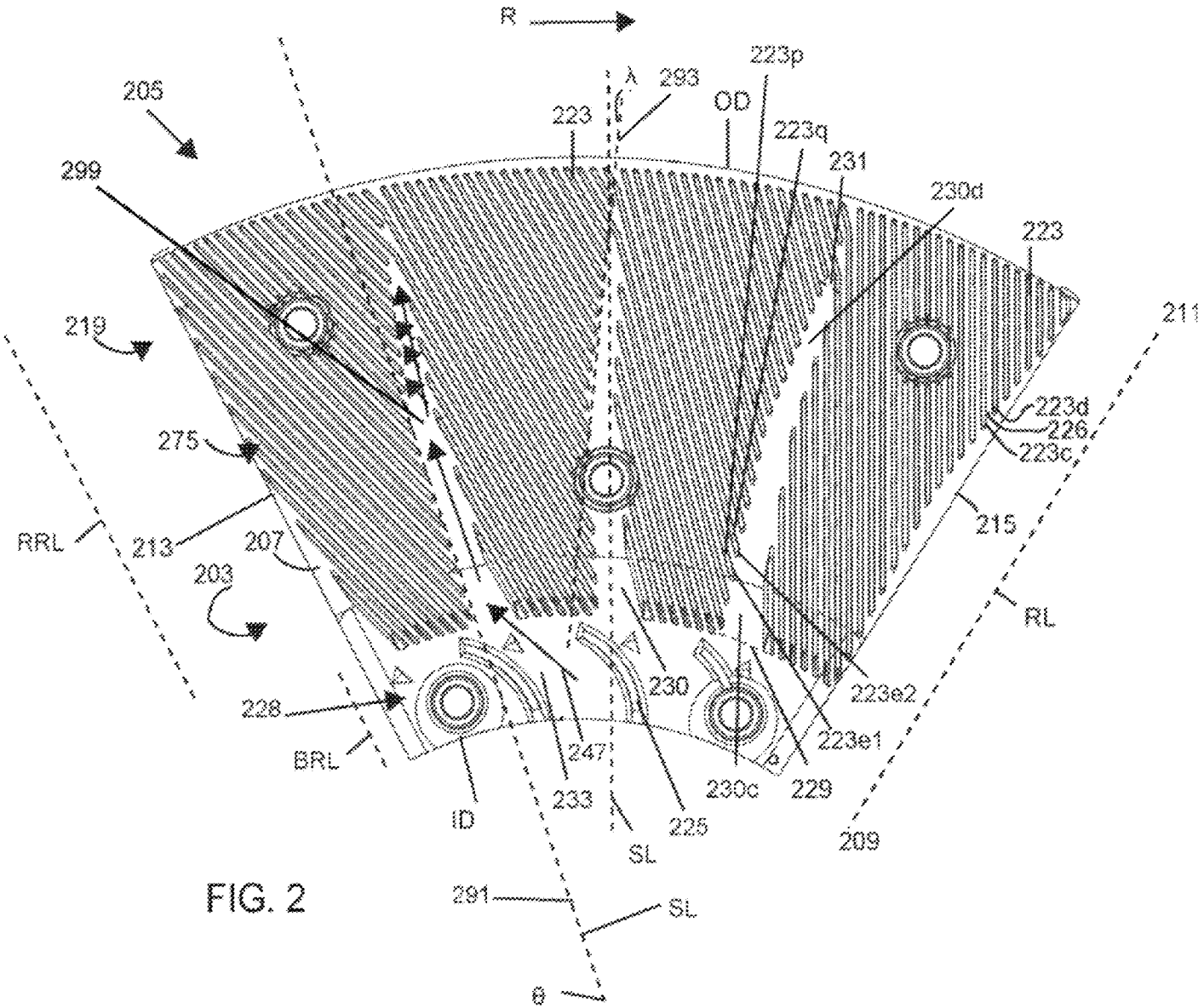
FIG. 2 is a facing view of an exemplary refiner plate segment.

FIG. 2 depicts refiner plate segment 205 for a refiner 100 (FIG. 1A) comprising: a substrate 207 having: a radial length RL, an inner diameter ID disposed at a first end 209 of the radial length RL, an outer diameter OD disposed at a second end 211 the radial length RL, the outer diameter OD located radially distant from the inner diameter ID along the radial length RL, the outer diameter OD being longer than the inner diameter ID, a first lateral side 213 extending between the inner diameter ID and the outer diameter OD along the radial length RL, a second lateral side 215 extending between the inner diameter ID and the outer diameter OD along the radial length RL, the second lateral side 215 being distally disposed from the first lateral side 213, and a back face 203 oppositely disposed from a front face 219 along a thickness, the back face 203 and the front face 219 extending between the outer diameter OD, inner diameter ID, first lateral side 213, and second lateral side 215, wherein the front face 219 further comprises an area having a plurality of alternating refining bars 223 and refining grooves 226, wherein the refining bars 223 engage the substrate 207 and wherein adjacent refining bars 223*c*, 223*d* (or 223*p* and 223*q*) and the substrate 207 define a refining groove 226 between the adjacent refining bars 223*c*, 223*d*, wherein the area (i.e. field) of alternating refining bars 223 and refining grooves 226 is known as "a refining section," 275 wherein the refining section 275 further comprises areas defining a feeding groove 230, the feeding groove 230 having a first width 229 closer to the inner diameter ID and a second width 231 closer to the outer diameter OD, wherein the first width 229 is larger than the second width 231, wherein the feeding groove 230 is disposed at a feeding angle θ at the first width 229, and wherein the feeding groove 230 is disposed at a holding angle λ at the second width 231.

Exemplary refiner plate segments 205 may further comprise a breaker bar section 228 comprising wide breaker bars 225 and wide spaces 233 between adjacent breaker bars 225. The breaker bars 225 break down incoming feed material 247 transferring the inner diameter ID of the refiner plate segment 205. The breaker bars 225 can be curved, straight, or disposed at multiple angles along the radial length RL of the breaker bar section 228 of the refiner plate segment 205. The breaker bars 225 in the breaker bar section 228 and the spaces 233 between the adjacent breaker bars 225 are wider than the refining bars 223 and the refining grooves 226 disposed between adjacent refining bars 223*c*, 223*d*. Angled or curved breaker bars 225 such as those depicted in FIG. 2 direct feed material 247 to move generally toward the first width 229 of the feeding groove 230 when the refiner plate segment 205 rotates in direction R. In the depicted embodiment, the refiner plate segment 205 is configured to rotate in a counter-clockwise direction. It will be understood that exemplary embodiments that have a refining pattern that is mirrored to the refining pattern shown in FIG. 2 can be configured to rotate in the clockwise direction. It will be further understood that certain exemplary embodiments may lack a breaker bar section 228.

The feeding groove 230 is defined by the area along the radial length RL of the refiner plate segment 205 between the substrate 207 and the ends 223*e* of refining bars 223 disposed successively along the radial length RL of the refiner plate segment 205, wherein a first end 233*e*1 of a first refining bar 223*p* is located at a first radial length, and wherein a second end 233*e*2 of a second refining bar 223*q* is located at a second radial length, wherein the second radial length RL2 is greater than the first radial length RL1.

The feeding angle θ (see FIG. 3) is an angle at the intersection between the of shortest radial line SL connecting the outer diameter OD to the inner diameter ID and the line 291 drawn to abut the refining bar ends 223*e* of at least two adjacent refining bars 223*p*, 223*q* in the inner feeding groove 230*c*. Lines are imaginary constructs depicted for reference. A radial line can be imagined to extend from the center of rotation radially outward past the outer diameter OD of the refiner plate segment 205. The refiner plate segment 205 rotates in direction R in the exemplary embodiment. The feeding angle θ permits inner feeding grooves 230*c* disposed closer to the inner diameter ID to push feed material 247 radially outward along the radial length RL and across the refiner plate segment 205 and into the refining gap disposed between the opposing refiner plate segments (see FIG. 1B).

Exemplary feeding angles θ of the inner feeding grooves 230*c* can be in a range from 0 degrees to 45 degrees. In certain exemplary embodiments, the feeding angles θ of the inner feeding grooves 230*c* can be in the range of 5 degrees to 20 degrees. In still other exemplary embodiments, the feeding angles θ of the inner feeding grooves 230*c* can be about 13 degrees to about 19 degrees. It will be understood that the feeding angle θ may vary among refiner plate segments 205 depending upon the dimensions of the refiner plate segment 205, the type of feed material 247 that the refiner plate segment 205 is configured to refine, the rate of refiner plate rotation, and the rate at which feed material 247 is introduced into the refiner 100.

The holding angle λ is an angle measured at the intersection between the shortest radial line SL connecting the outer diameter OD to the inner diameter ID and the line 293 drawn to abut the refining bar ends 223*e* of at least two adjacent refining bars (see 223*p*, 223*q*) in the outer feeding groove 230*d*. The holding angle λ permits outer feeding grooves 230*d* disposed closer to the outer diameter OD to redirect feed material 247 radially outward along the radial length RL into more radially outward refining grooves 226 and into the refining gap disposed between the opposing refiner plate segments. In this manner, the holding angle λ coupled with the direction of rotation R, can be thought to prolong the time that feed material 247 is present in the refining section 275 (compared to sections in the refining section 275 that are disposed at a feeding angle θ).

Exemplary holding angles λ of the outer feeding grooves 230*d* can be in a range from −3 degrees to −45 degrees. In certain exemplary embodiments, the holding angles λ of the outer feeding grooves 230*d* can be in the range of −10 degrees to −25 degrees. It will be understood that the holding angle λ may vary among refiner plate segments 205 depending upon the dimensions of the refiner plate segment 205, the type of feed material 247 that the refiner plate segment 205 is configured to refine, the rate of refiner plate rotation, and the rate at which feed material 247 is introduced into the refiner 100. It will be further understood that holding angles λ have the opposite orientation than feeding angles θ; therefore if a feeding angle θ is indicated as having a positive value, the holding angle λ is indicated as having a negative value and vice versa.

In an exemplary embodiment, the exemplary feeding grooves 230 transition from a feeding angle θ to a holding angle λ between 20% and 80% of the refining section radial length RRL of the refiner plate segment 205. The refining section radial length RRL is the length of the refining section 275. The refining section radial length RRL can typically be calculated by subtracting the breaker bar section length BRL from the overall radial length RL of the refiner plate segment 205. For example, if an exemplary refiner plate segment 205 has a radial length RL of 508 millimeters ("mm"), and a breaker bar section of 106 mm the exemplary feeding grooves 230 having a transition at 50% of the refining section radial length RRL can transition from a feeding angle θ to a holding angle λ at between 201 mm of the refining section radial length RRL, or 307 mm of the refiner plate segment radial length RL (i.e. a length that includes the breaker bar section length BRL) as measured from the inner diameter ID. In embodiments where the feeding grooves 230 are curved or change angles multiple times along the refining section radial length RRL, the feeding grooves 230 can transition from a feeding angle θ to a holding angle at any length of the refining section radial length, but it is preferably if the transition occurs in or above the upper fifth of the refining section radial length RRL as measured from the end of the refining section radial length RRL disposed closer to the inner diameter ID of the refiner plate segment 205.

In certain exemplary embodiments, the feeding groove 230 may extend to the outer diameter OD. Such embodiments may improve hydraulic capacity but reduce refining efficiency. In other exemplary embodiments, the feeding groove 230 may terminate before reaching the outer diameter OD such that refining bars 223 cross over the radially outer end of the feeding groove 230, thereby placing a physical stop of the feed material 247 passing through the feeding groove 230. This exemplary embodiment allows more refining bars 223 to be placed where the refining bars 223 have the highest peripheral velocity, and therefore, the highest refining efficiency.

Without being bound by theory, Applicant believes that disposing a feeding groove 230 on a refining plate segment 205, wherein the feeding groove 230 has a first width 229 disposed closer to the inner diameter ID than the second width 231, and a second width 231 disposed closer to the outer diameter OD than the first width 229, wherein the first width 229 is larger than the second width 231, wherein the feeding groove 230 is disposed at a feeding angle θ at the first width 229, and wherein the feeding groove 230 is disposed at a holding angle λ at the second width 231, permits the feeding groove 230 to direct feed material 247 substantially through the feeding groove 230 when the feeding groove 230 is disposed at a feeding angle θ while the refiner plate segment 205 rotates in direction R.

The inner diameter ID is shorter than the outer diameter OD. There is less area available for refining on the refiner plate segment 205 around the inner diameter ID compared to the area available around the outer diameter OD. For example, a breaker bar section 228 may abut the inner diameter ID itself. The breaker bar section 228 does not contribute to refining substantially; rather, the breaker bar section 228 is designed to break apart larger chunks of feed material 247 and direct these partially broken chunks of feed material 247 into the refining section 275. A refining section 275 may start immediately radially outward of the breaker bar section 228, but the space on the substrate 207 available for refining bars 223 and refining grooves 226 can be further limited by feeding grooves 230, which were traditionally seen as steam evacuation channels.

With the reduced available area, near the inner diameter ID, refining efficiency can be limited. By using an exemplary refiner plate segment 205 in accordance with this disclosure, it is contemplated that the holding angle λ of the outer feeding groove 230*d* and the narrowing of the outer feeding groove 230*d* can reduce the available area of the outer feeding groove 230*d* and force more feed material 247 into the refining grooves 226 and refining bars 223 that increasing populate the refining section 275 near the outer diameter OD. That is, as the feed material moves outwardly along the radial length RL, the area of the substrate 207 increases, thereby permitting the placement of more refining bars 223 and refining grooves 226. In this manner, the area of the refining section 275 increases outwardly along the radial length RL. It is contemplated that the exemplary feeding grooves 230 disclosed herein direct more feed material 247 into and across the radial distal refining section 275 to thereby increase hydraulic capacity (i.e. feed material flow rate) without sacrificing refining efficiency.

In certain exemplary embodiments, the refiner plate segment 205 has a feeding groove 230, wherein the feeding groove 230 is disposed at a series of angles 0-1 from the inner diameter ID to the outer diameter OD. In exemplary embodiments, wherein the feeding groove 230 is curved, the angle changes constantly along a radial length RL of the feeding groove 230 (e.g. gradually and continuously from a feeding angle 0 to a holding angle λ). In exemplary embodiments, the change in angle or the curvature of the feeding groove 230 will be directed where there is enough centrifugal force achieved for a given diameter of the assembled refiner plate segments 205 that is beyond the normal pulp plugging point 299.

Figure 3:
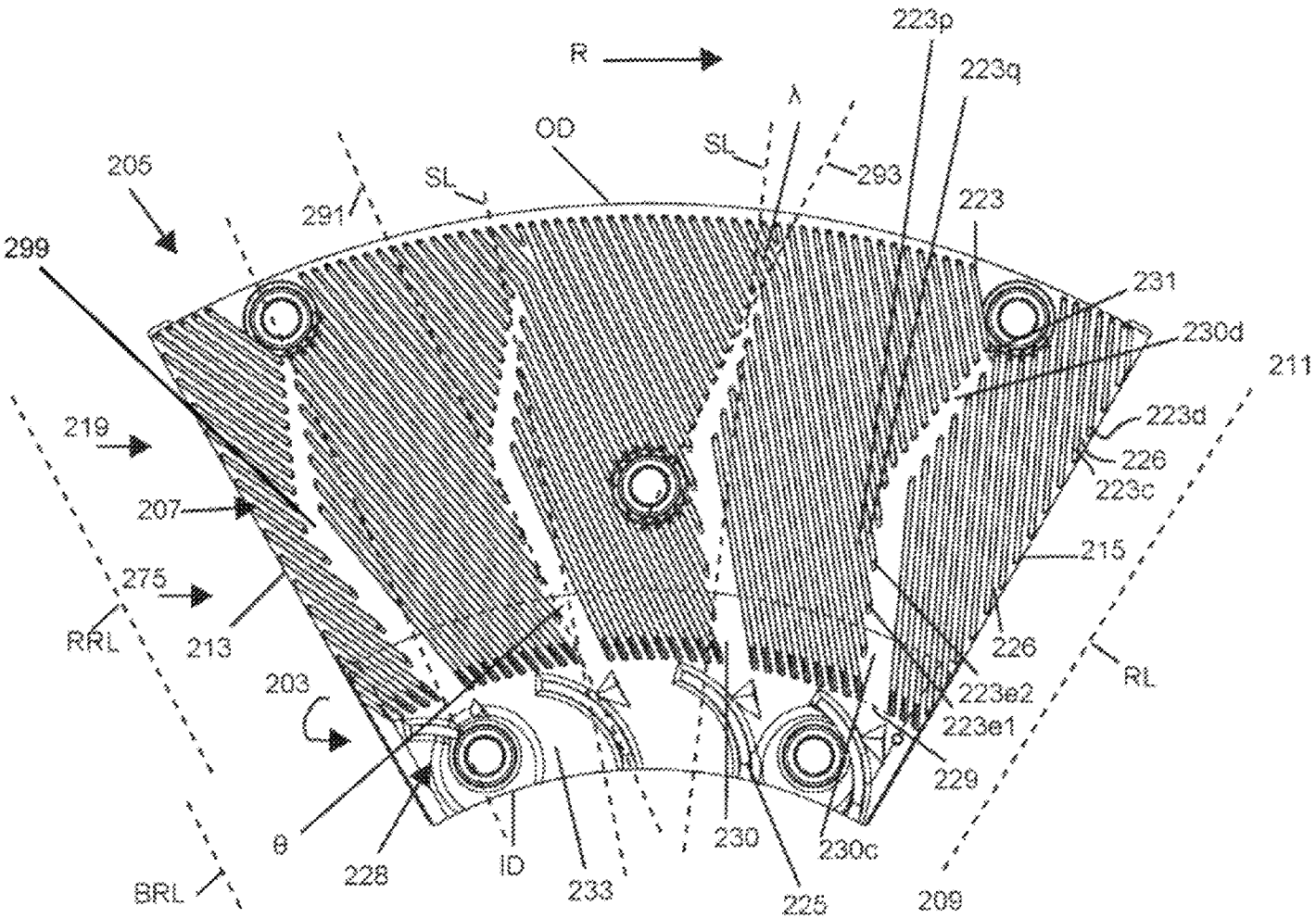
FIG. 3 is a facing view of an exemplary refiner plate segment.

FIG. 3 is another exemplary embodiment in accordance with the present disclosure, wherein the feeding grooves 230 have a more pronounced transition from the feeding angle θ to a holding angle λ compared to the embodiment shown in FIG. 2. In certain exemplary embodiments, the second end of the feeding groove (see 231) is disposed at the outer diameter OD. In other exemplary embodiments, the second end of the feeding groove (see 231) is disposed radially inward of the outer diameter OD.

It will be appreciated that combinations of the disclosed embodiments are considered to be within the scope of this disclosure. Furthermore, although the refiner plate segments 205 shown in FIGS. 2 and 3 are configured to work in a disk refiner 100, it will be understood that the refiner plate segments and patterns described herein can be used with conical refiners, disc refiners, cylindrical refiners, rotor-stator refiners, counter-rotating refiners, tri-conical refiners, and any other refiner configured to cut, develop, and separate fibrous material by using opposing refiner plate segments configure to define a refining gap.

It will further be appreciated that certain exemplary refiner plate segments 205 can comprise multiple refining sections 275, wherein a feeding groove 230 is disposed in multiple refining sections 275. For example, a first refining section can be located adjacent to a second refining section. By way of a further example a first refining section may be located radially inward of a second refining section. By way of another example, a first refining section may be located laterally to a second refining section.

An exemplary method for refining lignocellulosic material can comprise: pumping a feed material into a refiner, wherein the refiner has a "feeding groove refiner plate segment" comprising: an area having a plurality of alternating refining bars and refining grooves, wherein the refining bars engage a substrate and wherein adjacent refining bars and the substrate define a refining groove between the adjacent refining bars, wherein the area of alternating refining bars and refining grooves is known as "a refining section," wherein the refining section further comprises areas defining a feeding groove, the feeding groove having a first width closer to the inner diameter and a second width closer to the outer diameter, wherein the first width is larger than the second width, wherein the feeding groove is disposed at a feeding angle at the first width, and wherein the feeding groove is disposed at a holding angle at the second width; and refining the feed material with the feeding groove refiner plate segment.

An exemplary refiner plate segment for a refiner can comprise: a substrate having: a radial length, an inner diameter disposed at a first end of the radial length, an outer diameter disposed at a second end of the radial length, the outer diameter located radially distant from the inner diameter along the radial length, the out diameter being longer than the inner diameter, a first lateral side extending between the inner diameter and the outer diameter along the radial length, a second lateral side extending between the inner diameter and the outer diameter along the radial length, the second lateral side being distally disposed from the first lateral side, and a back face oppositely disposed from a front face along a thickness, the back face and the front face extending between the outer diameter, inner diameter, first lateral side, and second lateral side, wherein the front face further comprises an area having a plurality of alternating refining bars and refining grooves, wherein the refining bars engage the substrate and wherein adjacent refining bars and the substrate define a refining groove between the adjacent refining bars, wherein the area of alternating refining bars and refining grooves is known as "a refining section," wherein the refining section further comprises areas defining a feeding groove, the feeding groove having a first width closer to the inner diameter and a second width closer to the outer diameter, wherein the first width is larger than the second width, wherein the feeding groove is disposed at a feeding angle at the first width, and wherein the feeding groove is disposed at a holding angle at the second width.

In an exemplary embodiment, the feeding groove is disposed at a series of angles from the inner diameter to the outer diameter. In an exemplary embodiment, the feeding groove is curved, such that the angle changes constantly along a radial length of the feeding groove.

In an exemplary embodiment, a change in angle or the curvature of the feeding groove is disposed at a location where there is enough centrifugal force for a given diameter of the refiner plate segments that is beyond the normal pulp plugging point 299. In an exemplary embodiment, the feeding groove further comprises an inner feeding groove and an outer feeding groove, wherein the inner feeding groove has the first width disposed closer to the inner diameter of the refiner plate segment and the outer feeding groove has the second width disposed closer to the outer diameter of the refiner plate segment.

In an exemplary embodiment, wherein the feeding angle is an angle between a radial line and a line drawn to abut the refining bar ends of at least two adjacent refining bars in an inner feeding groove. In an exemplary embodiment, wherein the holding angle is an angle between the radial line and the line drawn to abut the refining bar ends of at least two adjacent refining bars in the outer feeding groove.

In an exemplary embodiment, the feeding angle is in a range from 0 degrees to 45 degrees. In an exemplary embodiment, the feeding angle is in a range from 5 degrees to 20 degrees. In an exemplary embodiment, the holding angle is in a range from −3 degrees to −45 degrees. In an exemplary embodiment, the holding angle is in a range from −10 degrees to −25 degrees.

In an exemplary embodiment, the feeding groove transitions from a feeding angle to a holding angle between 20% and 80% of a refining section radial length of the refiner plate segment as measured from a point of the refining section disposed closest to the inner diameter.

An exemplary refiner plate segment pattern can comprise: an area having a plurality of alternating refining bars and refining grooves, wherein the refining bars engage a substrate and wherein adjacent refining bars and the substrate define a refining groove between the adjacent refining bars, wherein the area of alternating refining bars and refining grooves is known as "a refining section," wherein the refining section further comprises areas defining a feeding groove, the feeding groove having a first width closer to the inner diameter and a second width closer to the outer diameter, wherein the first width is larger than the second width, wherein the feeding groove is disposed at a feeding angle at the first width, and wherein the feeding groove is disposed at a holding angle at the second width.

In an exemplary pattern, the feeding groove is disposed at a series of angles from the inner diameter to the outer diameter. In an exemplary pattern, the feeding groove is curved, such that the angle changes constantly along a radial length of the feeding groove. In an exemplary pattern, a change in angle or the curvature of the feeding groove is disposed at a location where there is enough centrifugal force for a given diameter of the refiner plate segments that is beyond the normal pulp plugging point 299.

In an exemplary pattern, the feeding groove further comprises an inner feeding groove and an outer feeding groove, wherein the inner feeding groove has the first width disposed closer to the inner diameter of the refiner plate segment and the outer feeding groove has the second width disposed closer to the outer diameter of the refiner plate segment.

In an exemplary pattern, wherein the feeding angle is an angle between a radial line and a line drawn to abut the refining bar ends of at least two adjacent refining bars in an inner feeding groove. In an exemplary pattern, wherein the holding angle is an angle between the radial line and the line drawn to abut the refining bar ends of at least two adjacent refining bars in the outer feeding groove.

In an exemplary pattern, the feeding angle is in a range from 0 degrees to 45 degrees. In an exemplary pattern, the feeding angle is in a range from 5 degrees to 20 degrees. In an exemplary pattern, the holding angle is in a range from −3 degrees to −45 degrees. In an exemplary pattern, the holding angle is in a range from −10 degrees to −25 degrees.

In an exemplary pattern, the feeding groove transitions from a feeding angle to a holding angle between 20% and 80% of a refining section radial length of the refiner plate segment as measured from a point of the refining section disposed closest to the inner diameter.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the invention.

What is claimed is:

1. A refiner plate segment for a refiner comprising:

a substrate having:

a radial length;

an inner diameter disposed at a first end of the radial length;

an outer diameter disposed at a second end of the radial length, the outer diameter located radially distant from the inner diameter along the radial length, the outer diameter being longer than the inner diameter;

a first lateral side extending between the inner diameter and the outer diameter along the radial length;

a second lateral side extending between the inner diameter and the outer diameter along the radial length, the second lateral side being distally disposed from the first lateral side; and a back face oppositely disposed from a front face along a thickness, the back face and the front face extending between the outer diameter, inner diameter, first lateral side, and second lateral side, wherein the front face comprises an area having a plurality of alternating refining bars and refining grooves, wherein the refining bars engage the substrate and wherein adjacent refining bars and the substrate define a refining groove between the adjacent refining bars, wherein the area of alternating refining bars and refining grooves is a refining section, wherein the refining section further comprises areas defining feeding grooves, each feeding groove extending into the refining section from an edge of the refining section having a closest radial distance from the inner diameter of the substrate toward the outer diameter of the substrate, each feeding groove having a first width closer to the inner diameter and a second width closer to the outer diameter, wherein the first width is larger than the second width, wherein the feeding groove is disposed at a feeding angle at the first width, and wherein the feeding groove is disposed at a holding angle at the second width, wherein the feeding angle is configured to push feed material radially outward and into the refining section, wherein the holding angle is configured to prolong refining time of the feed material, wherein the holding angle has an opposite orientation with respect to the feeding angle, wherein each feeding groove terminates before reaching the outer diameter such that the refining bars cross over a radially outer end of each feeding groove, and wherein each feeding groove transitions between the feeding angle at the first width closer to the inner diameter and the holding angle at the second width at a termination of the feeding groove.

2. The refiner plate segment of claim 1, wherein the feeding groove is disposed at a series of angles from the feeding angle at the inner diameter to the holding angle at the outer diameter.

3. The refiner plate segment of claim 1, wherein the feeding groove is curved, such that an angle of the feeding groove changes constantly between the feeding angle and the holding angle along a radial length of the feeding groove.

4. The refiner plate segment of any of claim 1, wherein a change in angle or curvature of the feeding groove between the feeding angle and the holding angle is disposed at a location where there is enough centrifugal force for a given diameter of the refiner plate segments that is beyond a normal pulp plugging point.

5. The refiner plate segment of any of claim 1, wherein the feeding groove further comprises an inner feeding groove and an outer feeding groove, wherein the inner feeding groove has the first width disposed closer to the inner diameter of the refiner plate segment and the outer feeding groove has the second width disposed closer to the outer diameter of the refiner plate segment.

6. The refiner plate segment of claim 5, wherein the feeding angle is an angle between a radial line and a line drawn to abut ends of at least two adjacent refining bars in the inner feeding groove.

7. The refiner plate segment of claim 5, wherein the holding angle is an angle between a radial line and a line drawn to abut ends of at least two adjacent refining bars in the outer feeding groove.

8. The refiner plate segment of claim 1, wherein the feeding angle is in a range from 0 degrees to 45 degrees.

9. The refiner plate segment of claim 1, wherein the feeding angle is in a range from 5 degrees to 20 degrees.

10. The refiner plate segment of claim 1, wherein the holding angle is in a range from −3 degrees to −45 degrees.

11. The refiner plate segment of claim 1, wherein the holding angle is in a range from −10 degrees to −25 degrees.

12. The refiner plate segment of claim 1, wherein the feeding groove transitions from the feeding angle to the holding angle between 20% and 80% of a refining section radial length of the refiner plate segment as measured from a point of the refining section disposed closest to the inner diameter.

13. A refiner plate segment pattern comprising:

an area having a plurality of alternating refining bars and refining grooves, wherein the refining bars engage a substrate and wherein adjacent refining bars and the substrate define a refining groove between the adjacent refining bars, wherein the area of alternating refining bars and refining grooves is a refining section, wherein the refining section further comprises areas defining feeding grooves, each feeding groove extending into the refining section from an edge of the refining section having a closest radial distance from an inner diameter of the substrate toward an outer diameter of the substrate, each feeding groove having a first width closer to the inner diameter and a second width closer to the outer diameter, wherein the first width is larger than the second width, wherein the feeding groove is disposed at a feeding angle at the first width, and wherein the feeding groove is disposed at a holding angle at the second width, wherein the feeding angle is configured to push feed material radially outward and into the refining section, wherein the holding angle is configured to prolong refining time of the feed material, wherein the holding angle has an opposite orientation with respect to the feeding angle, wherein each feeding groove terminates before reaching the outer diameter such that the refining bars cross over a radially outer end of each feeding groove, and wherein each feeding groove transitions between the feeding angle at the first width closer to the inner diameter and the holding angle at the second width at a termination of the feeding groove.

14. The pattern of claim 13, wherein the feeding groove is disposed at a series of angles from the feeding angle at the inner diameter to the holding angle at the outer diameter.

15. The pattern of claim 13, wherein the feeding groove is curved, such that an angle of the feeding groove changes constantly between the feeding angle and the holding angle along a radial length of the feeding groove.

16. The pattern of claim 13, a change in angle or curvature of the feeding groove between the feeding angle and the holding angle is disposed at a location where there is enough centrifugal force for a given diameter of the refiner plate segments that is beyond a normal pulp plugging point.

17. A method for refining lignocellulosic material comprising:

pumping a feed material into a refiner, wherein the refiner has a feeding groove refiner plate segment comprising:

an area having a plurality of alternating refining bars and refining grooves, wherein the refining bars engage a substrate and wherein adjacent refining bars and the substrate define a refining groove between the adjacent refining bars, wherein the area of alternating refining bars and refining grooves is a refining section, wherein the refining section further comprises areas defining feeding grooves, each feeding groove extending into the refining section from an edge of the refining section having a closest radial distance from an inner diameter of the substrate toward an outer diameter of the substrate, each feeding groove having a first width closer to the inner diameter and a second width closer to the outer diameter, wherein the first width is larger than the second width, wherein the feeding groove is disposed at a feeding angle at the first width, and wherein the feeding groove is disposed at a holding angle at the second width, wherein the feeding angle is configured to push feed material radially outward and into the refining section, wherein the holding angle is configured to prolong refining time of the feed material, wherein the holding angle has an opposite orientation with respect to the feeding angle, wherein each feeding groove terminates before reaching the outer diameter such that the refining bars cross over a radially outer end of each feeding groove, and wherein each feeding groove transitions between the feeding angle at the first width closer to the inner diameter and the holding angle at the second width at a termination of the feeding groove; and refining the feed material with the feeding groove refiner plate segment.

* * * * *